US008210105B2

(12) United States Patent
Bjørgum

(10) Patent No.: US 8,210,105 B2
(45) Date of Patent: Jul. 3, 2012

(54) METHOD AND DEVICE FOR DETONATING AN EXPLOSIVE CHARGE

(75) Inventor: Stig Ove Bjørgum, Voss (NO)

(73) Assignee: TCO AS, Beagen (NO)

( * ) Notice: Subject to any disclaimer, the term of this patent is extended or adjusted under 35 U.S.C. 154(b) by 298 days.

(21) Appl. No.: 12/087,138

(22) PCT Filed: Jan. 3, 2007

(86) PCT No.: PCT/NO2007/000003

§ 371 (c)(1),
(2), (4) Date: Sep. 25, 2008

(87) PCT Pub. No.: WO2007/078205

PCT Pub. Date: Jul. 12, 2007

(65) Prior Publication Data

US 2009/0217810 A1 Sep. 3, 2009

(30) Foreign Application Priority Data

Jan. 3, 2006 (NO) ..... 20060012

(51) Int. Cl.
*F42C 5/00* (2006.01)
*F42D 3/00* (2006.01)

(52) U.S. Cl. ..... 102/313; 102/323; 89/1.15; 166/55.1; 166/299; 175/4.56

(58) Field of Classification Search ..... 102/313, 102/314, 322, 323, 331, 304; 89/1.15; 166/55–55.3, 166/63, 297, 299; 175/2–4.6
See application file for complete search history.

(56) References Cited

U.S. PATENT DOCUMENTS

| | | | | |
|---|---|---|---|---|
| 3,712,378 | A * | 1/1973 | Olivier | 166/299 |
| 4,886,126 | A | 12/1989 | Yates | |
| 5,632,348 | A | 5/1997 | Yunan | |
| 5,680,905 | A | 10/1997 | Green | |
| 7,712,406 | B2 * | 5/2010 | Reimers | 89/1.15 |
| 2004/0118562 | A1 * | 6/2004 | George | 166/297 |
| 2006/0180013 | A1 | 8/2006 | Reimers | |

FOREIGN PATENT DOCUMENTS

| | | | |
|---|---|---|---|
| EP | 0 721 051 | | 7/1996 |
| EP | 721051 | A2 * | 7/1996 |
| WO | WO 2004 104512 | | 12/2004 |
| WO | WO 2004104512 | A2 * | 12/2004 |

* cited by examiner

*Primary Examiner* — James Bergin
(74) *Attorney, Agent, or Firm* — Francis C. Hand; Carella, Byrne, Cecchi, Olstein, Brody, et al.

(57) ABSTRACT

A method for detonation of a plug device in a fluid environment is described, which is in contact with a body, such as an ignition pellet, and it is characterized in that a number of pressure increases are exerted against the plug device, whereby each pressure increase causes a movement of a piston (10) which is radially arranged in a casing (12), which causes the casing (12) to move a fixed distance inward in the plug device with each pressure increase, up until the displacement of the casing (12) causes the piston to be displaced into a cavity (38), and the fluid environment enters the plug device via an inlet. Also described is a plug device which is in contact with a body, such as an ignition pellet, where the plug device is arranged to detonate after a number of pressure increases that are exerted against the plug device. The plug device/ignition pellet can be applied to initiate a detonation process which leads to perforation of a pipe wall or to perforate or remove/explode plugs in oil wells or gas wells, thereby starting production from a reservoir through a pipe.

7 Claims, 2 Drawing Sheets

METHOD AND DEVICE FOR DETONATING AN EXPLOSIVE CHARGE

This application is based on PCT/NO2007/000003, filed Sep. 25, 2007.

The present invention relates to a method and a device for detonation of an explosive charge in a liquid environment, and where the explosive charge is in contact with a body, such as an ignition pellet.

Also given is a preferred application of the invention.

More precisely the invention relates to an ignition device of an ignition mechanism which is applied to detonate an explosive charge (an explosive) which is placed down in liquid-filled pipes and well holes.

The explosive charge is arranged to be remote controlled to detonate the explosive charge, for example, to perforate a pipe wall or to perforate a lining or a pipe wall in oil wells or gas wells. Such a perforation in an outlying pipe wall or lining is often necessary to release the fluid from the reservoir into the production pipe such that the oil production is initiated. The present invention can be applied to such a production start.

The explosive charges are also applied to blow up test plugs (such as of glass or ceramic) which are temporarily placed, in a sealing way, down in the well. The well, for example, above the plug is tested with high pressure to check that well linings and pipes are sufficiently leak-proof. When the test is completed the plug is removed in that it is blown up. The present invention can be applied to blow up such test plugs.

PRIOR ART

To trigger explosive charges for different applications, is previously known, and is based on release by mechanical means or by using an electrical primer with a cable connection.

Remote controlled ignition pellets, which are based on the use of pressure increases via a liquid inside a pipe or a well bore, are known from U.S. Pat. Nos. 5,680,905, 5,632,348 and 4,886,127. A rupture disc or the like inside the pipe is made to break so that the pressure exerts a force onto a piston which in turn is moved and will start the detonation of a detonating cartridge inside the pellet.

From the applicant's own patent application WO 2004/1045512 an explosive charge is described which is triggered to detonate by means of a sequence of pressure oscillations (pulses) which can be exerted from the liquid inside the pipe or in the well from the exit side. When a number of pressure oscillations (pulses) are exerted a fatigue fracture occurs in the metal which in turn opens the pellet such that the fluid is admitted to the interior of the pellet, and initiates the triggering of the detonation of the explosive charge.

The disadvantage with this exploding mechanism is that the exertion of the pressure oscillations is very unpredictable, in that the metal is influenced by all pressure changes. This can lead to an earlier than expected metal fatigue, such that the explosion happens at the wrong time.

Reference is also made to what is known from US-patent publication US-2004/0118562.

It is an aim of the present invention to provide a plug device with an explosive charge that performs more dependably for use during testing of drill pipes.

It is a further aim with the invention to provide a plug device with an explosive device which explodes exactly when it is expected and desired to explode.

Another aim with the invention is to provide detonation of the explosive charge of the plug device as a result of a predetermined number of pressure pulses which are exerted from the fluid in the pipe/well from the exit side, such as from the surface.

The method according to the invention is characterized in that it provides a number of pressure increases against the plug device, whereby each pressure increase brings about a movement of a piston which is radially arranged within a casing, which results in that the casing moves a fixed distance inwards in the plug device for each pressure increase, up until the moving of the casing causes the piston to be pushed into a cavity, and the fluid enters the plug device via an inlet, thereby the fluid bringing about the detonation of the explosive charge.

The preferred embodiments of the method are characterized in that the piston is pushed inwards in the plug device a corresponding distance as the casing when a pressure increase is exerted against the plug device and whereby the piston is displaced back to its start position when the pressure increase is nullified. The method is further characterized in that the number of pressure increases which shall be exerted against the plug device before detonation is activated is predetermined.

The plug device according to the invention is characterized in that the plug device comprises a piston which is radially arranged within a casing, and where the casing is arranged to be moved a fixed distance inwards in the plug device with the help of the piston's movement with each pressure increase, up until the moving of the casing provides a gap for the piston to be pushed into a cavity, and the fluid is added to the plug device via an inlet, thereby the fluid bringing about the detonation of the explosive charge.

The preferred embodiments of the plug device are characterized in that the piston is displaced inward in the plug device a corresponding distance as the casing when a pressure increase against the plus device is exerted and whereby the piston is displaced back to its start position when the pressure increase ceases and in that the number of pressure increases which shall be exerted against the plug device before detonation is activated, is predetermined.

In addition, the plug device is characterized in that the casing is arranged with a cavity, the piston is arranged with a cavity with these two cavities arranged to coincide at the last of the predetermined number of pressure changes, and in that a number of spheres or the like, which are arranged between the cavities and are displaced into the aligned cavities, and the piston is displaced into the cavity.

The plug device comprises a spring which is arranged to control the displacement of the casing and/or the piston the fixed distance inward in the plug device at a pressure increase.

The plug device comprises a stop device, which is arranged at the end of the spring, to control the displacement of the casing and/or the piston the fixed distance inward in the plug device for each pressure pulse exerted.

The casino and/or the piston is equipped with a number of external tracks around their circumference, where each track is arranged with the same distance between each other in the axial direction.

The upper cover of the plug device and/or the casing is fitted with a number of locking elements which are arranged to keep the piston and/or casing in the correct position in relation to each other at any time, with the help of the tracks in the piston and/or the casing. The locking elements are chosen from the group comprising discs, screws, plates, C-rings, threads and the like.

According to the invention the plug device is used with the explosive charge (the ignition pellet) to initiate a detonation process which leads to the perforation of a pipe wall or to perforate or remove/explode test plugs in oil wells and gas wells, thereby starting production from a reservoir through a pipe, for example.

SHORT DESCRIPTION OF THE FIGURES

DETAILED DESCRIPTION OF THE FIGURES

Figure 3:
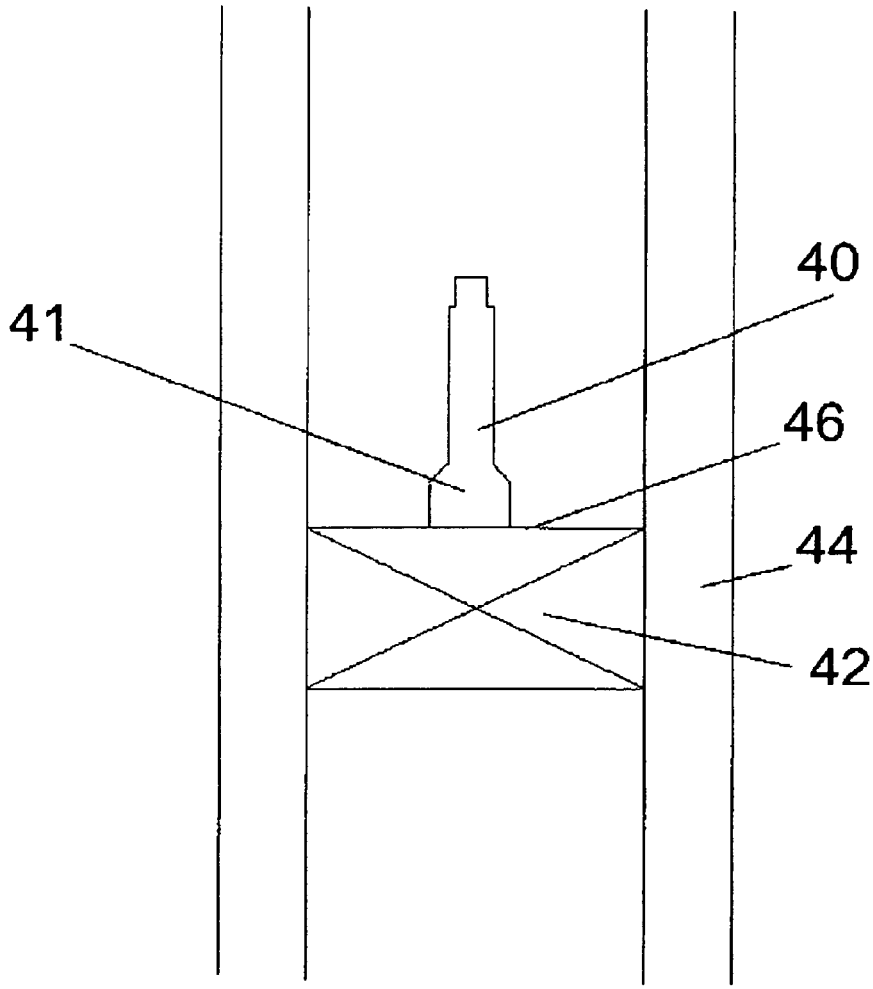
FIG. 3 shows an example of an application of the plug device according to the invention in a production pipe, for removal of a test plug.

Initially reference is made to FIG. 3 which shows the invented plug device in connection with the explosion of a plug. The explosive charge 41 (or ignition pellet) itself is shown lying lowest in the plug device 40 at 41. The plug device is placed in close contact with the surface 46 of a glass plug which is to be blasted away.

The inventive construction details with the present invention are associated to the uppermost part of the device 40 and apply to the detonation mechanism in a plug device which causes the charge to explode. The detonation is brought about in that the well fluid 48 (at a controlled point in time), enters into the construction, something which leads to a great increase in pressure, such that, for example, a firing piston is pushed down and gets the charge 42 to explode. Alternatively, the solution can be that the intruding well fluid with high pressure causes an encapsulation around the explosive charge to burst or dissolve (for example, chemically) such that the explosive charge detonates. The invention is based on that one can now accurately set the time for when the explosive charge shall detonate.

Figure 1:
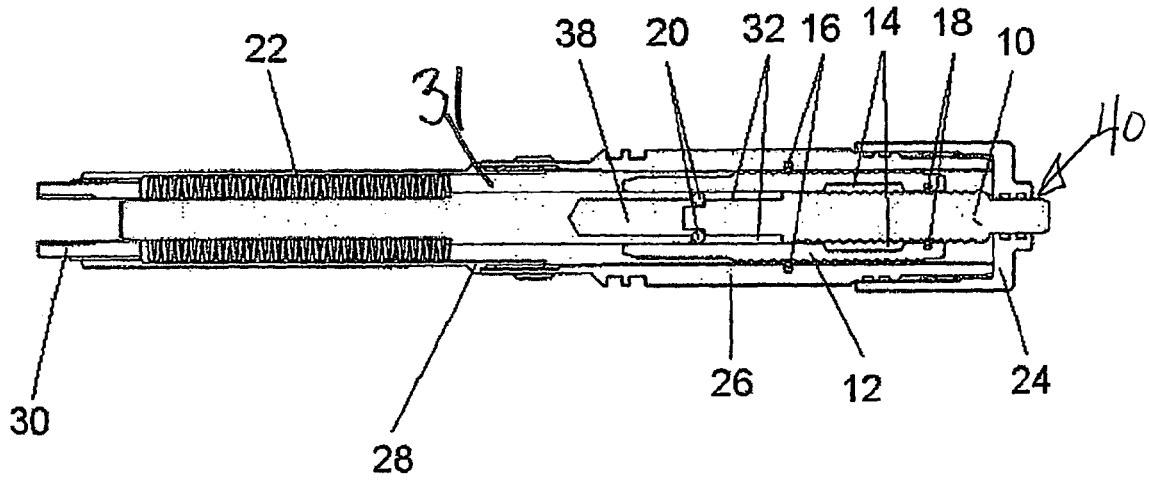
FIG. 1 shows a cross section of the plug device according to the present invention.
Figure 2:
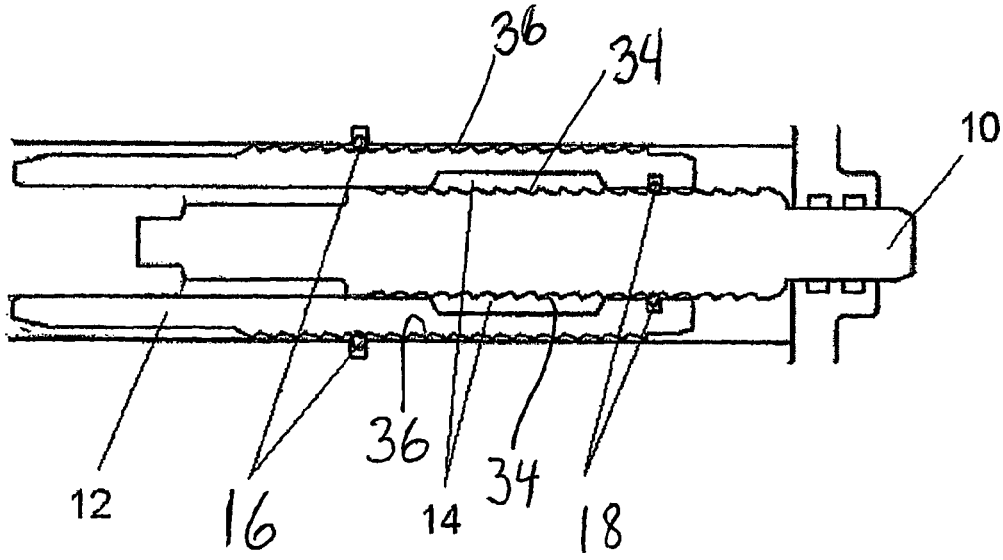
FIG. 2 shows an enlarged cross section of the essential parts of the plug device according to the present invention.

FIG. 1 and FIG. 2 show a cross section of the plug device according to the invention, and it comprises a firing piston 10 to activate the detonation of the explosive charge of the plug device. The firing piston 10, which is coaxially arranged in a casing 12, FIG. 2. An external upper house 24 and an upper casing-formed cover 26 are arranged surrounding the outer side of the mentioned arrangement. The upper part of the firing piston 10 passes through an opening 40 in the end surface of the upper house 24, and at a given distance outside (above) this.

The piston 10 and/or the outer surface of the casing 12 is formed with a number of parallel tracks 34 and 36, respectively, around the circumference of the casing/firing piston, where each track is arranged with the same interval between each other in the axial direction, such that the piston or the casing's surface shows a groove-formed or barbed-formed surface. It is preferred that the tracks 34, 36 slope in opposite directions in relation to each other such as is clearly shown in FIG. 2. A number of locking elements 16, 18, such as discs, screws, plates, C-rings, threads, etc., hold the casing 12 and the piston 10 in a fixed position in relation to each other at all times. The locking elements 16 can be arranged in the upper cover's 26 inner circumference adjacent to the casing 12, and abuts (or lightly engage with) one of the tracks 34 on the casing 12, such that the casing is held fast in a fixed position when a pressure pulse (pressure difference) on the plug device is not being exerted. The locking elements 18 can be arranged in the casing's 12 (inner) circumference adjoining the piston 10. The locking elements 18 abut (or lightly engage with) one of the tracks 36, such that the piston is kept locked in a fixed position.

When a pressure pulse (pressure oscillation) on the plug device is being exerted, and then preferentially a considerable pressure increase at least in the order of 300-400 bar, the plug device is "triggered" to activate the detonation of the plug device, in that the piston 10 is pushed a fixed interval or distance, such as a few millimetres, inwards into the plug device, which corresponds to the interval between two barbs or grooves. When the piston 10 is pushed inwards, the casing 12 is also pushed a corresponding interval or distance inward into the plug device, and the locking elements 16 are pushed in this process from the tracks they are arranged in to a nearest lying track in the direction which is opposite to the direction of movement of the casing 12 inward into the plug device. The plug device can be arranged with a spring 22 such as one or a number of coil springs to regulate this displacement distance. The springs are arranged in an annulus around the circumference of the body 31. A stopping device (not shown), such as a stop screw or bolt, can be arranged at the end of the plug device, close to the lower house 30, which can also regulate the displacement interval in that the piston is stopped by this stop device when it is led inward a given distance by the exertion of a pressure pulse. The spring 22 and/or the stopping device are also arranged so that the piston 10 and the casing 12 are only pushed inward (to the left in the figure) a distance which corresponds to the interval between two adjacent barbs or grooves.

When the pressure (the pressure pulses) that is exerted on the plug device decreases to the original pressure in the well pipe, the piston 10 is displaced back to the start position. When the piston 10 is displaced out again the locking elements 16 retain the casing 12 in its position in one of the tracks 34, such that it is not moved back with the piston 10. In this process, the locking elements 18 are displaced from the tracks that they are arranged in, to the nearest lying track in the direction which corresponds to the direction of movement inward in the plug device.

The tracks 34, 36, alone or in combination with the locking elements 16,18, can be arranged to only allow movement of the locking elements 16,18 in one direction at a time, such that it is not possible for the locking elements 16,18 to be moved in the opposite way. This can be achieved with receptors in the tracks, or another corresponding arrangement to bring about the same function.

It should also be noted that the invention is not limited to the embodiment example according to FIGS. 1 and 2, but that the tracks 34 can alternatively be arranged in other places, for example, on the inside of the upper cover 26, and correspondingly that the locking elements 16 are arranged on the outside of the casing. Also other alternatives can be used as long as the movement of the casing 12 is moved reciprocally in relation to the piston 10 as described above.

Alternatively, other fastening techniques that do not include tracks can be used, but rather embodiments with barbs/grooves which extend outside the casing's circumference, and the associated locking elements must then be adapted to this embodiment.

The result of the method described above is that for each time that a pressure difference (pressure pulse) is exerted against the plug device, and the plug device is "triggered", the casing is led a fixed distance inward in the casing and the plug device will be a step nearer detonation. By exerting a pressure difference on the plug device a number of predetermined times, a controlled countdown to detonation is then achieved. This means that the pressure in the fluid is subjected to a continual exchange, in the form of pulses, between low and high pressure. The number of pulses which is required so that detonation will occur can be determined in advance, by dimensioning of the inner construction of number of incisions or barbs 34,36 so that the parts inside the device will reciprocally move one step (incision/barb) for each pulse. For example, it can be constructed with a freely chosen number of movement grooves, for example, up to 25 incisions, so that 25 pressure pulses are required to trigger the detonation. Herein lies the time setting of the detonation, as the operators from the installation on the surface control the number of pressure pulses and need only control the number of times a pressure pulse corresponding to the number of incisions in the plug device is exerted.

The plug device is also arranged to detonate after a predetermined number of pressure increases against the plug device. Detonation of the plug device happens in the following way:

The casing 12 is arranged with an internal recess around its circumference for the formation of a cavity 14 which adjoins the piston 10. The piston 10 is arranged with a foremost cavity 38 and a ring-formed cavity 32, where, in between, a number of spheres 20 are arranged around the circumference in a ring formed seat in the passage between the end of the piston 10 and the plug pole 31 of the house 30 which goes further into the explosive charge unit. When a predetermined number of pressure pulses are exerted, the last pressure increase will cause the cavity 14 and 32 to line up or merge so that the spheres 20 are displaced from their fixed positions and radially in into the "new" merged cavity 14 and 32. Then the casing 12 goes completely into the spring peg and the piston 10 is pushed into the cavity 38. This also leads to an inlet being opened up in the upper house 24 where the piston 10 previously entered through the end surface of the casing 24, and well fluid penetrates into the plug device.

The plug device is originally filled with a gas under atmospheric pressure or lower pressure. Therefore a strong pressure change arises in the plug device 40 when the well fluid penetrates, and the plug 42 is destroyed in that a piston strikes the detonator such that the explosive charge explodes.

As mentioned, FIG. 3 shows an embodiment example of how the plug device 40, with an explosive charge 41, can be arranged in connection with a plug 42 which is mounted in a bore pipe 44. As the figure shows, the exploding section 41 of the plug device 40 is arranged in close contact or approximate contact with the object (for example, a glass plug) 42 which the explosive charge 41 shall use its explosive power against and destroy, with its one end standing right on the surface 46 of the plug 42. On carrying out the pressure pulses which are described in the above mentioned method, the well fluid 48 in the pipe will ultimately enter the mechanism such that the explosive charge is detonated and explodes away the plug 42.

The plug can be installed for pressure testing of a pipe, where the ignition pellet in devices that has an aim of detonating an explosive charge and pulverising the plug when the test is conducted.

The invention claimed is:

1. A plug device comprising an elongated cover;

a house secured at one end of said cover and having an inlet opening therein;

a casing coaxially disposed within said elongated cover for movement relative to said cover from a fixed position towards a displaced position; and a piston for engaging an ignition pellet for detonation of the ignition pellet, said piston being coaxially disposed within said casing and projecting through said inlet opening for movement from a start position projecting through said inlet opening into a retracted position relative to and spaced from said inlet opening.

2. A plug device as set forth in claim 1 further comprising at least one locking element disposed between said elongated cover and said casing for selectively holding said casing in an incremented position between said fixed position and said displaced position in response to a series of pressure pulses being exerted against said piston and at least one locking element between said casing and said piston for selectively holding said piston in an incremented position between said start position and said retracted position in response to said series of pressure pulses.

3. A plug device as set forth in claim 2 wherein said casing has an external track of barb-shaped surfaces for selectively engaging with said locking element between said cover and said casing and said piston has an external track of barb-shaped surfaces for selectively engaging with said locking element between said piston and said casing.

4. A plug device as set forth in claim 2 further comprising a spring for biasing said casing in a direction towards said fixed position.

5. A plug device as set forth in claim 1 further comprising a body coaxially within said elongated cover having a chamber for receiving said piston in said retracted position thereof.

6. A plug device as set forth in claim 5 further comprising a plurality of spheres between said piston and said body, said casing having an internal cavity for receiving said spheres with said casing in said displaced position thereof to allow said piston to move into said chamber of said body.

7. In a plug device for detonating an ignition pellet in a liquid filled pipe, the combination comprising an elongated cover;

a house secured at one end of said cover and having an inlet opening therein;

a casing coaxially disposed within said elongated cover for movement relative to said cover from a fixed position towards a displaced position;

a piston for engaging an ignition pellet for detonation of the ignition pellet, said piston being coaxially disposed within said casing and projecting through said inlet opening for movement from a start position projecting through said inlet into a retracted position relative to and spaced from said inlet to allow liquid from the pipe to penetrate into the plug device;

a spring for biasing said casing in a direction towards said fixed position;

a body coaxially within said elongated cover having a chamber for receiving said piston in said retracted position thereof; and a plurality of spheres between said piston and said body, said casing having an internal cavity for receiving said spheres with said casing in said displaced position thereof to allow said piston to move into said chamber of said body.

* * * * *